US012178343B2

(12) United States Patent
McCutcheon

(10) Patent No.: US 12,178,343 B2
(45) Date of Patent: Dec. 31, 2024

(54) DEVICE FOR SECURING TEMPERATURE SENSITIVE PACKAGES

(71) Applicant: Johnathan McCutcheon, Houston, TX (US)

(72) Inventor: Johnathan McCutcheon, Houston, TX (US)

( * ) Notice: Subject to any disclaimer, the term of this patent is extended or adjusted under 35 U.S.C. 154(b) by 0 days.

(21) Appl. No.: 17/522,748

(22) Filed: Nov. 9, 2021

(65) Prior Publication Data

US 2023/0157471 A1 May 25, 2023

(51) Int. Cl.
*A47G 29/14* (2006.01)
*A47G 29/30* (2006.01)

(52) U.S. Cl.
CPC ..... *A47G 29/141* (2013.01); *A47G 29/30* (2013.01)

(58) Field of Classification Search
CPC ..... A47G 29/141; A47G 29/30; A47G 29/20; A47G 29/22; A47G 2029/142; A47G 2029/147; A47G 2029/149; B65D 21/086
See application file for complete search history.

(56) References Cited

U.S. PATENT DOCUMENTS 2,229,646 A * 1/1941 Firestone ..... A47G 29/1223 220/6
6,426,699 B1 * 7/2002 Porter ..... A47F 10/00 340/568.1
10,299,617 B1 * 5/2019 Castellanos ..... A47G 29/141
10,321,780 B1 * 6/2019 James ..... A47G 29/141
10,537,196 B1 * 1/2020 MacPherson ..... A47G 29/141
10,709,276 B2 * 7/2020 Guanch ..... A47G 29/20
10,743,693 B2 * 8/2020 Newcomb ..... E06B 7/32
10,743,695 B1 * 8/2020 Altmaier ..... B60R 9/065
10,772,451 B2 * 9/2020 Vernal Silva ..... A47G 29/20
11,087,269 B2 * 8/2021 Newcomb ..... A47G 29/141
11,311,132 B2 * 4/2022 Eivaz ..... A47G 29/141
11,617,465 B2 * 4/2023 Zhang ..... A47G 29/141 232/38
11,666,169 B1 * 6/2023 Altmaier ..... A47G 29/20 232/33
11,751,708 B2 * 9/2023 Wu ..... A47G 29/141 232/19
2003/0006275 A1 * 1/2003 Gray ..... A47G 29/14 232/19
2003/0038457 A1 * 2/2003 Eskridge ..... B62B 3/04 280/648
2016/0331171 A1 * 11/2016 Jiang ..... A47G 29/141
2017/0334603 A1 * 11/2017 Zaremski ..... D05B 91/12
2018/0228310 A1 * 8/2018 Enobakhare ..... A47G 29/20
2018/0296016 A1 * 10/2018 Teoh ..... A47G 29/20
(Continued)

*Primary Examiner* — William L Miller
(74) *Attorney, Agent, or Firm* — Bennett C. David, Esq.

(57) ABSTRACT

A package securing device configured to secure temperature sensitive packages, is disclosed. The device includes a plurality of panels configured to form an enclosure for receiving one or more packages. The device includes a set of scissor retractors configured to extend and retract the plurality of panels. The device includes a locking handle positioned across the width of the enclosure, connecting the set of scissor retractors and configured to lock the scissor retractors in one or more extended positions relative to the shape of the received one or more package. The device includes a retractable cover configured to cover the enclosure relative to the size of the enclosure as formed by the scissor retractors.

14 Claims, 10 Drawing Sheets

(56) References Cited

U.S. PATENT DOCUMENTS

| | | | | |
|---|---|---|---|---|
| 2019/0180544 | A1* | 6/2019 | Newcomb | E06B 7/32 |
| 2019/0225375 | A1* | 7/2019 | Sena | A47G 29/20 |
| 2019/0261802 | A1* | 8/2019 | Vernal | A47G 29/20 |
| 2019/0320836 | A1* | 10/2019 | Guanch | A47G 29/20 |
| 2019/0350398 | A1* | 11/2019 | Raphael | A47G 29/141 |
| 2019/0362577 | A1* | 11/2019 | Vigil | G07C 9/27 |
| 2021/0127880 | A1* | 5/2021 | Raphael | A47G 29/141 |
| 2021/0267401 | A1* | 9/2021 | Benevento | A47G 29/141 |
| 2021/0339905 | A1* | 11/2021 | Darkwah | E05B 65/52 |
| 2022/0031105 | A1* | 2/2022 | Newcomb | G06Q 10/0833 |
| 2022/0089317 | A1* | 3/2022 | Aliahmad | A47G 29/20 |
| 2022/0248888 | A1* | 8/2022 | Willhoit | A47L 23/266 |
| 2022/0257041 | A1* | 8/2022 | Redford | B65D 11/186 |
| 2022/0267048 | A1* | 8/2022 | Rogers | A47G 29/141 |
| 2022/0312999 | A1* | 10/2022 | Myrick | A47G 29/141 |
| 2022/0346583 | A1* | 11/2022 | Evangelidis | A47G 29/20 |
| 2022/0379939 | A1* | 12/2022 | Codispoti | B65D 25/2808 |
| 2022/0395124 | A1* | 12/2022 | Meddah | G08B 3/10 |

* cited by examiner

215

DEVICE FOR SECURING TEMPERATURE SENSITIVE PACKAGES

FIELD OF THE INVENTION

This disclosure relates to package securing devices.

Specifically, this disclosure relates to a device for securing temperature sensitive packages.

BACKGROUND

The home delivery market has expanded from receiving product packages to receiving packages that may include food, frozen items, cold items, perishable items or temperature sensitive items. Package and mail receiving systems are well known in the art and are effective means to receive deliveries. For example, FIG. 1 depicts a conventional system 101 having a mailbox 103 for receiving mail 105 therein.

In accordance, when being delivered, the residents or receivers can experience concerns with the integrity of these type of products especially when mail and packages are often commonly left for long periods of time prior to being retrieved. Most commonly, it is conventional for larger packages to be left on the porches or next to doors. In order to ensure that these items are able to be secured and be maintained for freshness, there is a need for a device that is not only able to secure a package, but also able to secure packages that are required to be in temperature-controlled environments.

Accordingly, embodiments of the invention, provide significant advantages while overcoming the above-described and other disadvantages, as will now be described.

SUMMARY

Several embodiments for securing a temperature sensitive package are described herein. In one representative embodiment, a package securing device configured to secure temperature sensitive packages, is disclosed. The device includes a plurality of panels configured to form an enclosure for receiving one or more packages. At least one of the panels is configured to be secured to a fixed structure.

Accordingly, when the set of scissor retractors are extended the enclosure is formed, and when retracted the plurality of panels are collapsible. The device includes a set of scissor retractors configured to extend and retract the plurality of panels. The device includes a locking handle positioned across the width of the enclosure, connecting the set of scissor retractors and configured to lock the scissor retractors in one or more extended positions relative to the shape of the received one or more package. The device includes a retractable cover configured to cover the enclosure relative to the size of the enclosure as formed by the scissor retractors.

In one embodiment, the enclosure is configured with a bottom panel in communication with a plurality of side panels, wherein the bottom panel is covered with a fabric configured to stretch to the size of the enclosure, based on an extended positioned of the set of scissor retractors.

In one embodiment, the set of scissor retractors configured to retract the plurality of panels to be flush with the fixed structure.

In one embodiment, the locking handle is configured to lock the movement of the set of scissor retractors in the extended position or the retracted position.

In one embodiment, the locking handle is configured to pull and tightens a fabric upper portion of a base panel configured to support the one or more packages resulting in the fabric comprising of a tight fit over the frames of the enclosure.

In one embodiment, the locking handle comprises of a locking mechanism that includes a piston elbow comprising a piston configured to fold and unfold the set of scissor retractors. The locking mechanism includes a piston cylinder configured to secure the positioning of the locking mechanism. The locking mechanism includes a plurality of serrated teeth secured to the piston configured to be in contact with a plurality of saw teeth of a ratchet, locking the set of scissor retractors into the one or more positions. The locking mechanism includes a solenoid configured to extend or retract the set of scissor retractors in the event that the system lacks power.

In one embodiment, the device further includes a controller.

In one embodiment, the controller is configured to extend or retract the set of scissor retractors upon activation by manual user interaction or a user equipment.

In one embodiment, the controller comprises one or more sensors configured to determine a position to lock the set of scissor retractors.

In one embodiment, the one or more sensors comprises an infrared red proximity sensor, or a camera sensor configured to record based on movement and the activation or deactivation of the set of scissor retractors caused by the controller.

In one embodiment, the controller comprises one or more LEDs comprising a red LED indicating an in use status, a yellow LED indicating an error or low battery status, and a green LED indicating a ready and lock not engaged status.

In one embodiment, the controller is configured to receive one or more commands from an application programming interface (API) operable via a user equipment.

In one embodiment, the API is configured to receive one or more instructions from a user including activating the locking handle, deactivating the locking handle, and extending the cover.

In one embodiment, the one or more panels comprise of insulated walls configured to maintain a predetermined temperature.

This summary is provided merely for purposes of summarizing some example embodiments, so as to provide a basic understanding of some aspects of the subject matter described herein.

Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

Disclosed herein are embodiments of a package delivery system. This description includes drawings, wherein.

Figure 1:
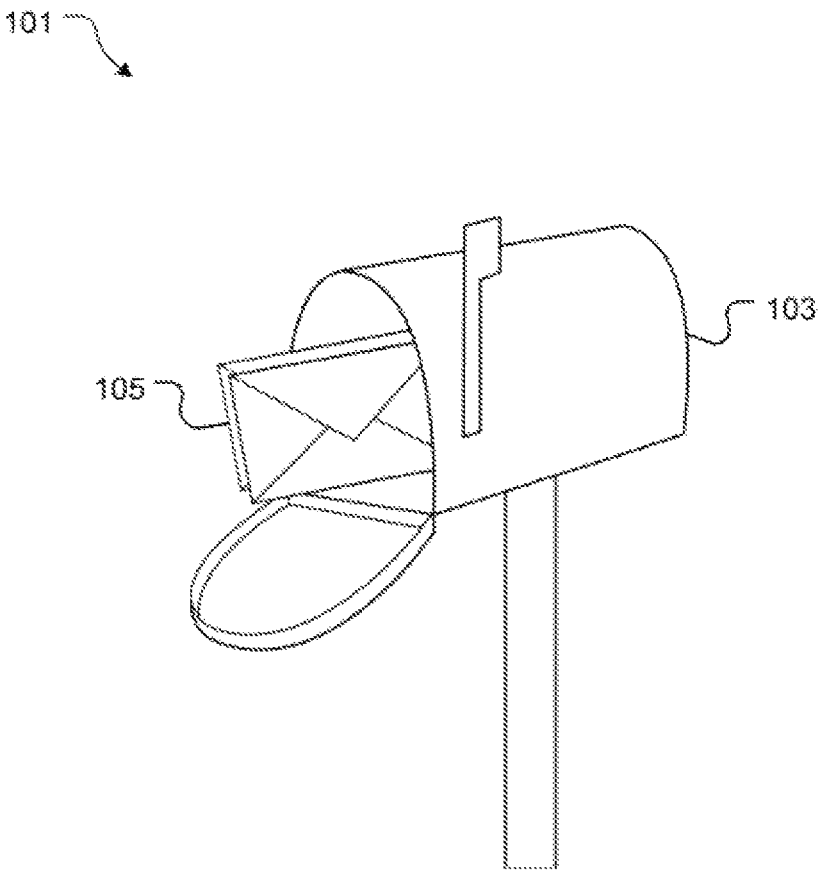
FIG. 1 (Prior Art)
FIG. 1 is a front view of a common package delivery system, in accordance with an example.

Elements in the figures are illustrated for simplicity and clarity and have not been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

The invention may be embodied in other specific forms without departing from the spirit of essential characteristics thereof. The present embodiments therefore to be considered in all respects as illustrative and not restrictive, the scope of the invention being indicated by the appended claims rather than by the foregoing description, and all changes which come within the meaning and range of equivalency of the claims are therefore intended to be embraced therein.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The following description is not to be taken in a limiting sense but is made merely for the purpose of describing the general principles of exemplary embodiments. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
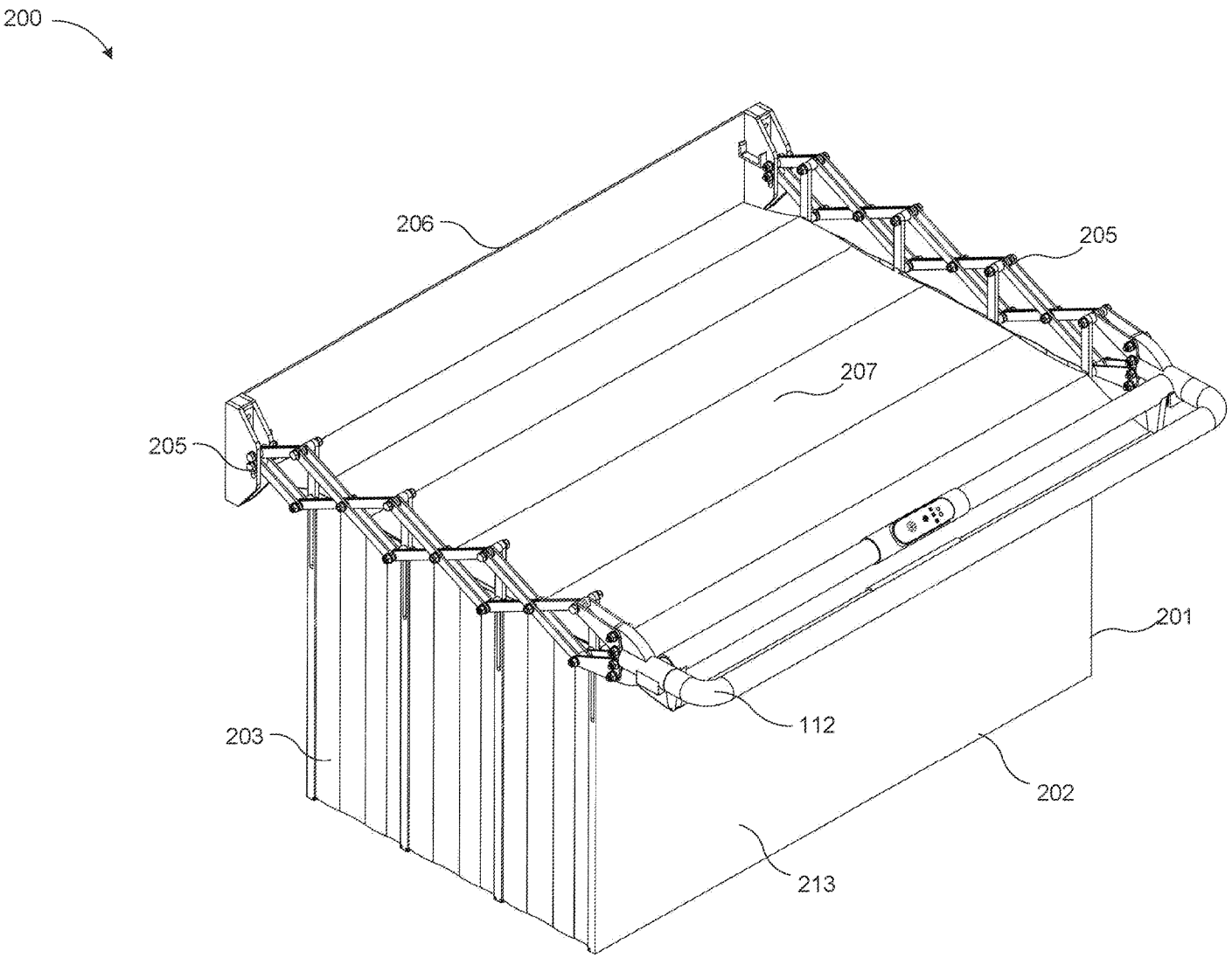
FIG. 2 depicts a perspective view of a box locking system for temperature sensitive packages, in accordance with a preferred embodiment of the present application.

Referring now to the drawings wherein like reference characters identify corresponding or similar elements throughout the several views, FIG. 2 depicts a perspective view of a box locking system for temperature sensitive packages 200, in accordance with a preferred embodiment of the present application. It will be appreciated that the system 200 overcomes one or more of the problems commonly associated with conventional package receiving systems.

In the contemplated embodiment, system 200 includes an enclosure 201 having a base 202 and a cover 207 configured to form an interior area that is positioned between the base 202 and the cover 207. The enclosure 201 can be configured to comprise multiple shapes and sizes relative to the size of the packages and amount of items that will be secured within the enclosure 201. The base 202 and cover 207 can secure together through any conventional means, such as snapping into place, clasps, locks, or the like. As shown in the current embodiment of FIG. 2, the system includes a locking handle 209 that is configured to secure the cover 207 to a plurality of panels 203, that form walls, relative to the size of the base 202. Thus, the enclosure 201 is formed based on the base 202 relative to the size of the cover 207.

The locking handle 209 is positioned across the width of the base 202, connecting a set of scissor retractors 205 on opposite sides of the enclosure 201 adjacent to each set of the plurality of panels 203. The scissor retractors 205 are configured to be locked into position thus also locking the scissor retractors in position when in an extended position by the locking handle 209. The cover 207 can be formed by an insulating material that is formed of fabric or another material capable of insulating and maintaining the temperature needed within the inside of the enclosure 201. Accordingly, the locking handle 209 is configured to be retractable, to pull and tighten the fabric of the cover 207 over the top of the enclosure 201. The retractable scissors are configured to be secured to a deployment frame 206 from which the retractable scissors 205 are configured to extend from and retract towards.

Figure 3:
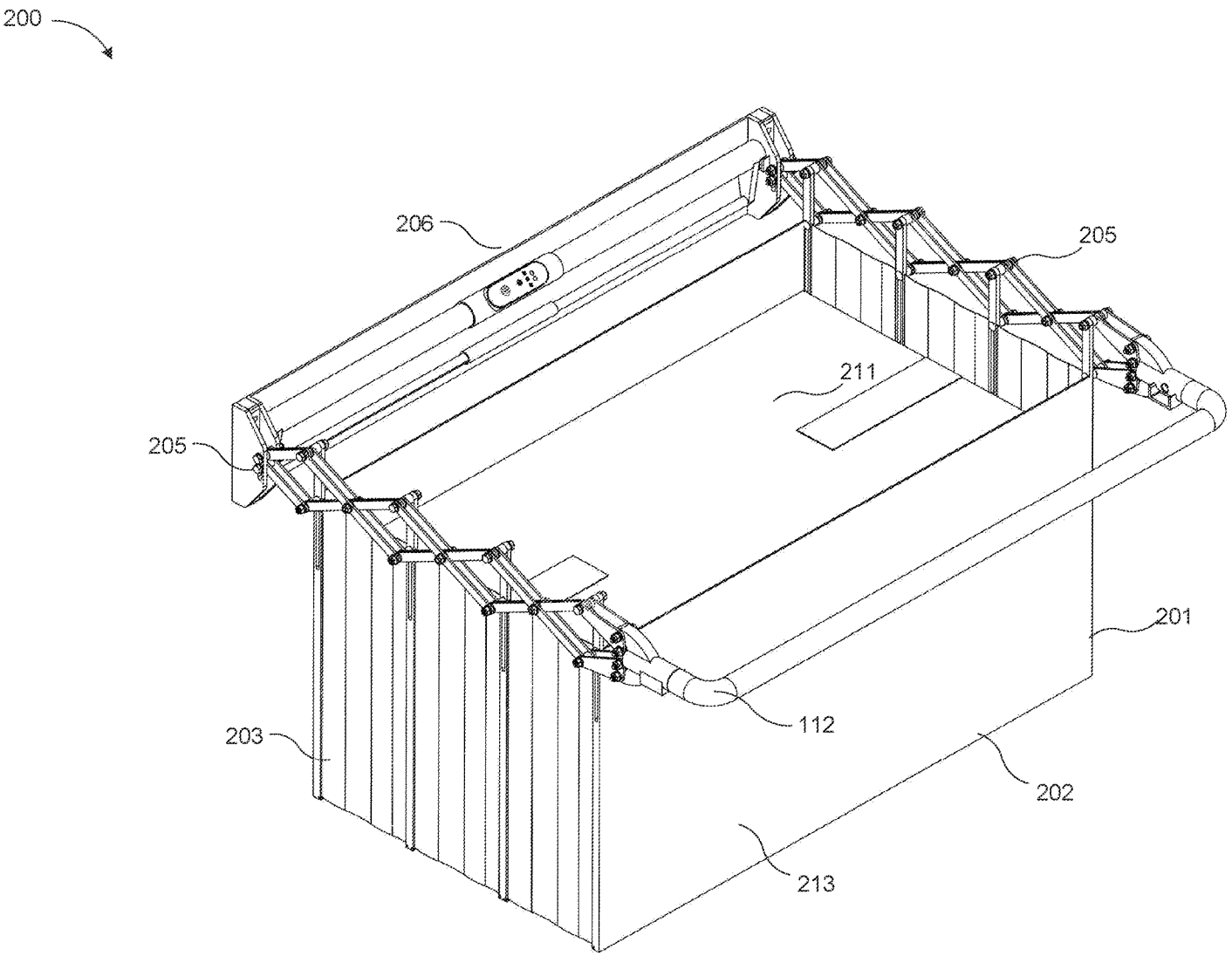
FIG. 3 depicts an open enclosure perspective view of the box locking system for temperature sensitive packages, in accordance with an example.

FIG. 3 depicts an open enclosure perspective view of the box locking system 200 for temperature sensitive packages. The enclosure 201, includes a bottom panel 211 in communication with a plurality of side panels, which is configured to receive one or more items or packages. The bottom panel 211 can be made of an insulated material that is configured to maintain a predetermined temperature to maintain the temperature of the items or packages within the enclosure 201. The bottom panel 211 is covered with a fabric configured to stretch to the size of the enclosure 201, based on an extended positioned of the set of scissor retractors 205.

In one embodiment, the scissor retractors 205 are configured to extend from the deployment frame 206, in a forward direction based on the size of the one or more packages within the enclosure 201. As the scissor retractors 205 move forward, extending accordingly, the enclosure 201 increases in volume until the determined size is reached. The bottom panel 211 is configured to have stretch properties, which allows the fabric to extend in size according to the bottom panels size that is created based on the increase in volume. The locking mechanism is configured to be retained against the deployment panel 206 until the enclosure 201 is intended to be enclosed, securing and insulating at the predetermined temperature within the enclosure 201. In some embodiments, the deployment panel can be secured to a fixed structure, and mounted on a commercial or residential building.

Once the enclosure 201 is ready to be covered, the cover 207, attached to the locking handle 209, is extended forward, in order to enclose the volume of the enclosure 201 until a front panel 213 of the enclosure 201 is reached. The front panel 213 is positioned based on the extension of the scissor retractors 205, as shown in FIG. 2. The scissor retractors 205 are configured to extend as far as the retaining bar 210 of the device 200.

Figure 4:
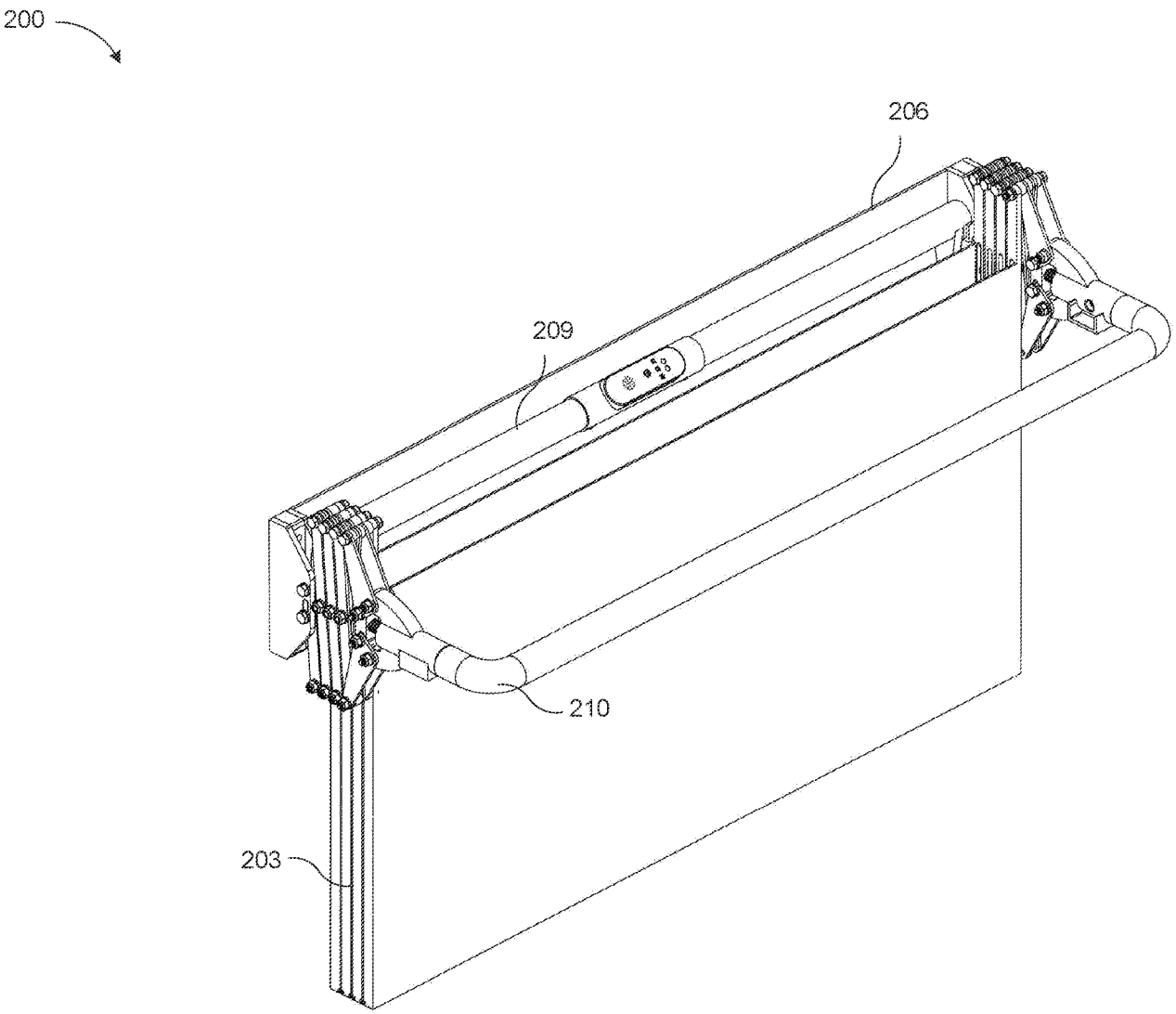
FIG. 4 depicts a retracted view of the box locking system for temperature sensitive packages, in accordance with an example.

FIG. 4 depicts a retracted view of the box locking system 200 for temperature sensitive packages. As shown, in FIG. 4, the locking handle 209 is configured to be positioned in an up position adjacent to the deployment panel 206. In the up position, the locking handle 209 allows the scissor retractors 205, currently positioning the plurality of panels in a folded position, to be enabled to be unfolded by pulling on the retaining bar 210. The retaining bar 210 is configured to be pulled forward, extending the scissor retractors 205, to create an enclosure that allows one or more packages to be retained within.

Figure 5:
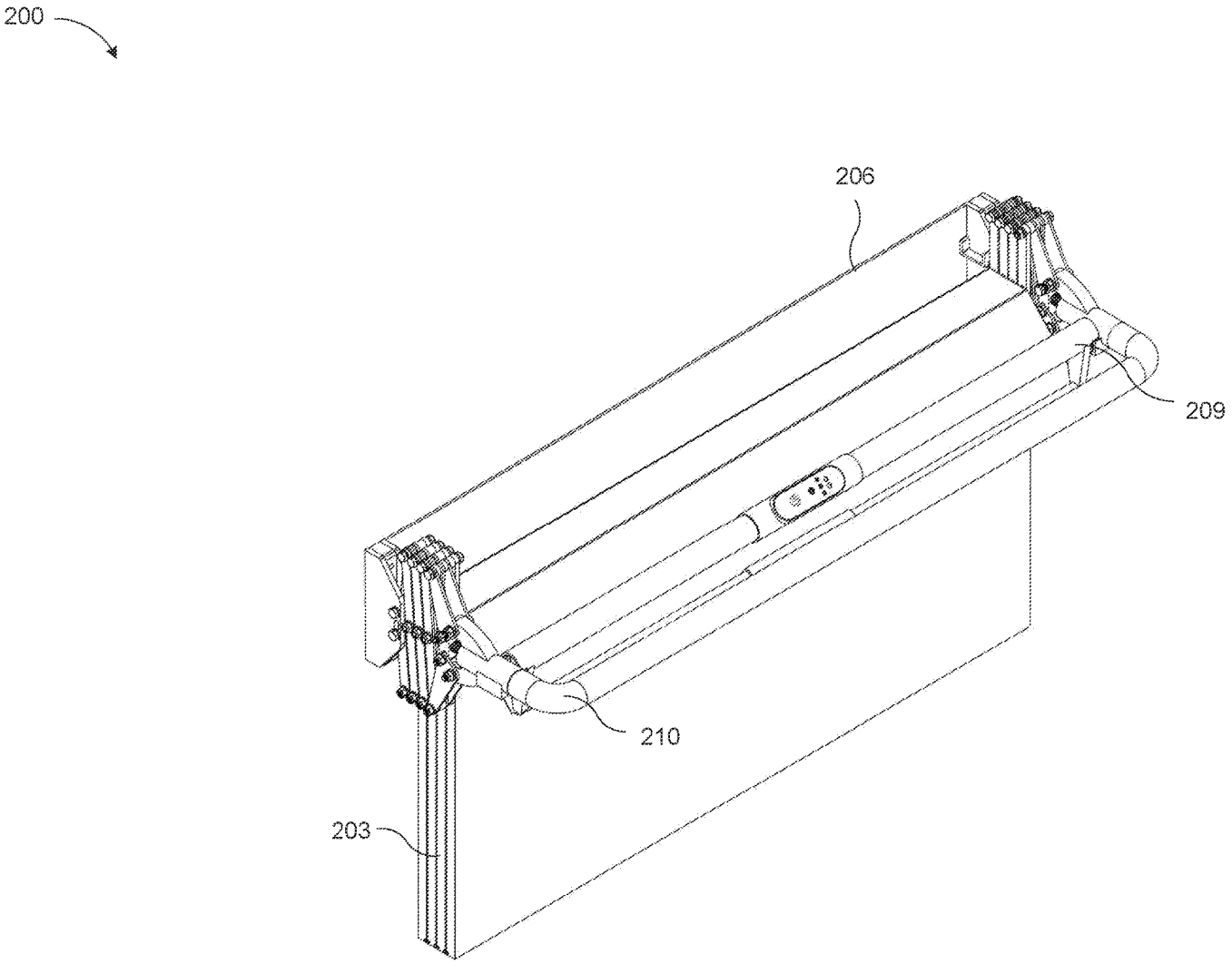
FIG. 5 depicts another retracted view of the box locking system for temperature sensitive packages, in accordance with an example.

FIG. 5 depicts another retracted view of the box locking system 200 for temperature sensitive packages. When the locking handle 209 is in the down position, the device is de-energized, and the system is locked. Thus, the scissor retractors 205 are unable to be retracted. In one embodiment, the positioned of the locking handle 209 in a downward position also deactivates one or more motors that are configured to motorize the one or more scissor retractors 205.

Figure 6:
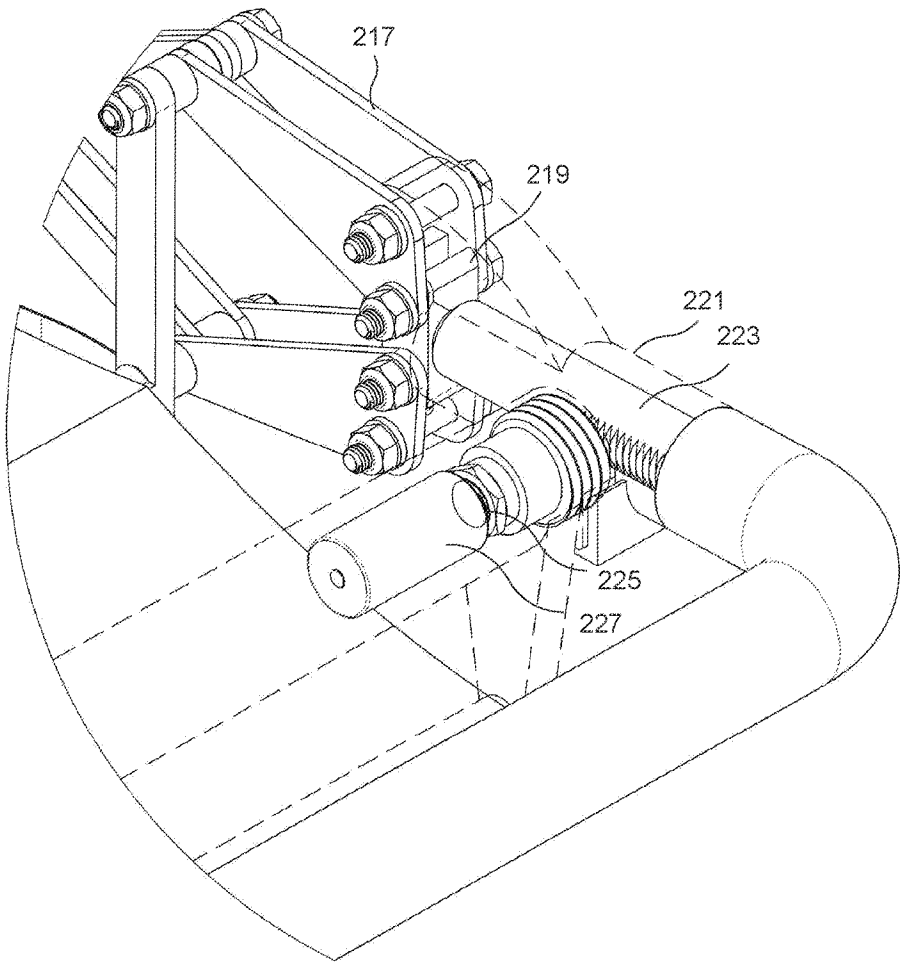
FIG. 6 depicts the locking mechanism of the box locking system, in accordance with an example.
Figure 7:
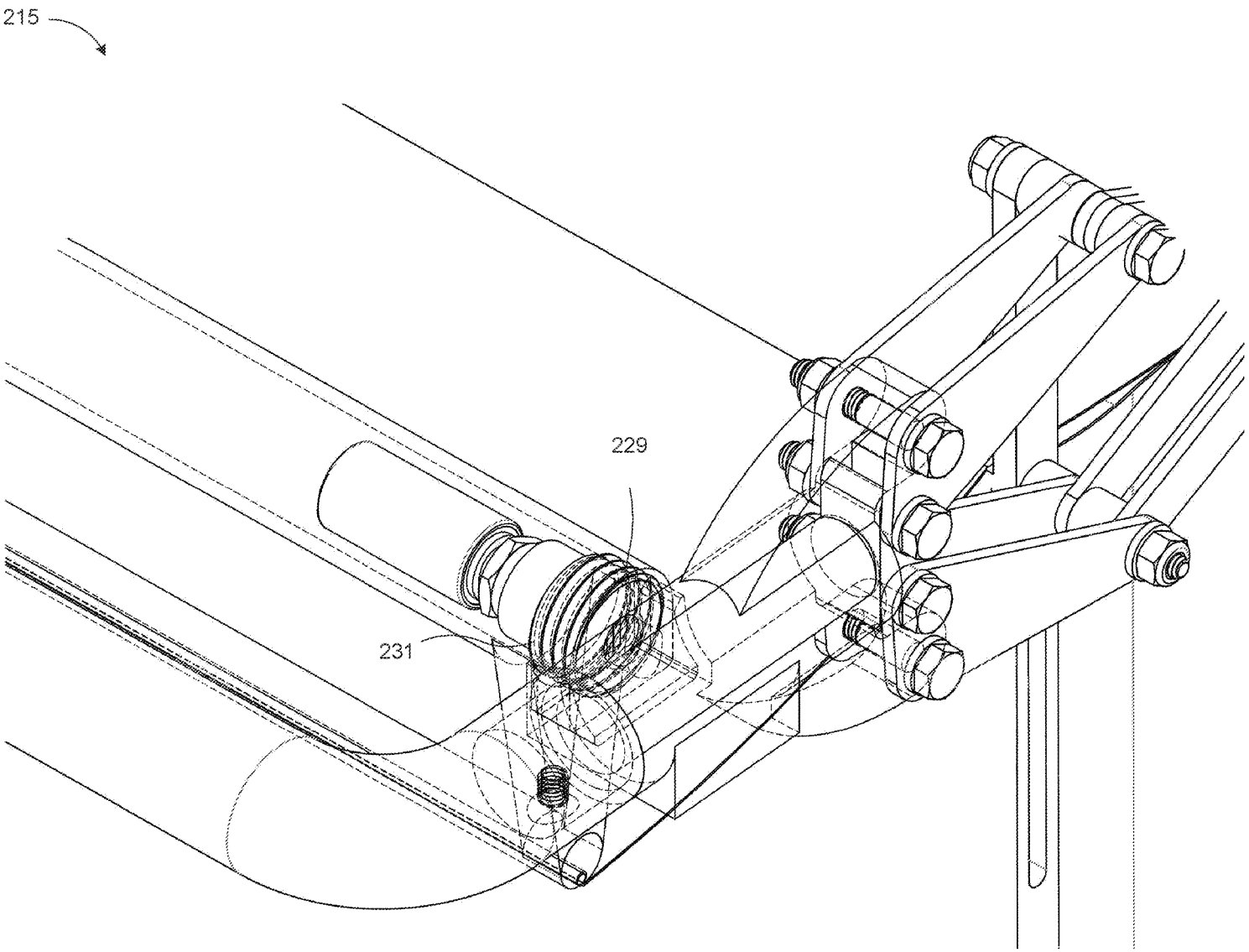
FIG. 7 depicts another view of the locking mechanism of the box locking system, in accordance with an example.

FIG. 6 depicts the locking mechanism 215 of the box locking system 200. The locking mechanism 215 is positioned on the front scissor of the scissor retractors 205, and in communication with the locking handle 209. The locking mechanism includes piston scissors that moves the piston elbow 219 when unfolding or closing the front scissor of the scissor retractors. The piston elbow 219 itself, is configured to move the piston 223. The piston 223, enclosed within the piston cylinder 221, has serrated teeth so that a ratchet 225 can lock the piston in position relative to the size of the scissor retractors 205. The ratchet 225 itself has saw teeth, as shown in FIG. 7, that fit the piston saw teeth, enabling them to lock the ratchet 225 in the proper scissor position relative to the size of the package. The ratchet 225 is connected to a solenoid 227. The solenoid 227 is configured to extend when there isn't any power that is associated with the locking mechanism. If the ratchet 225 is pressed, the piston will be locked, preventing the scissor retractors 205 from movement, in reaction to the stem of the solenoid being extended. If the stem of the solenoid is retracted, the solenoid is energized, resulting in the piston being released, which allows the scissor retractors 205 to regain movement capability.

Figure 8:
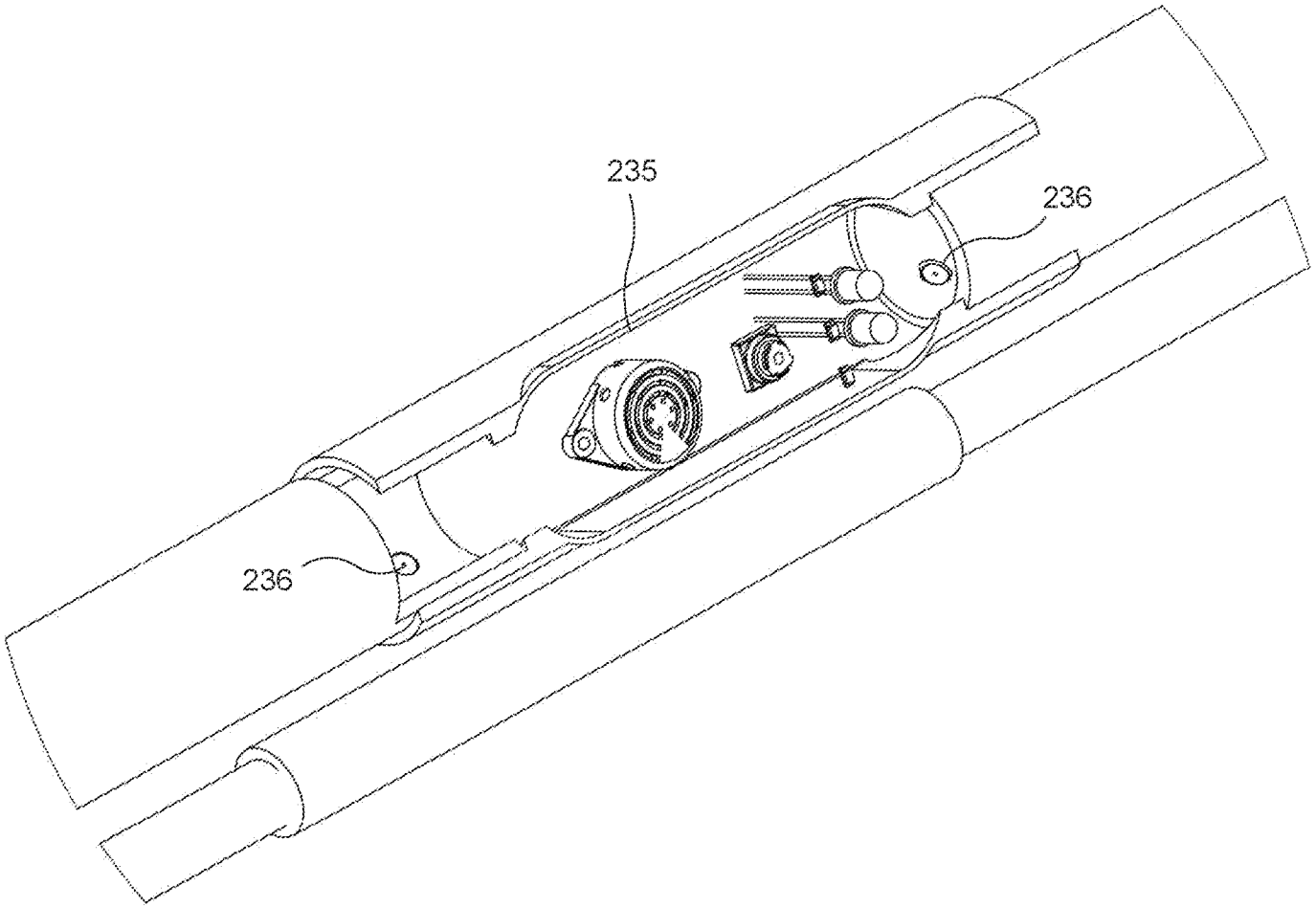
FIG. 8 depicts the locking handle of the of the box locking system, in accordance with an example.

FIG. 8 depicts the locking handle 209 of the of the box locking system 200. The locking handle 209 is configured to house the entire controller mechanism that can comprise of a central controller 235. The central controller 235 is configured to control and operate the entire control mechanism, a plurality of sensors, and a plurality of LEDs that are inserted in the central compartment. The control mechanism 235 is configured to be secured to the locking handle 209 by one or more securing devices such as screws.

Figure 9:
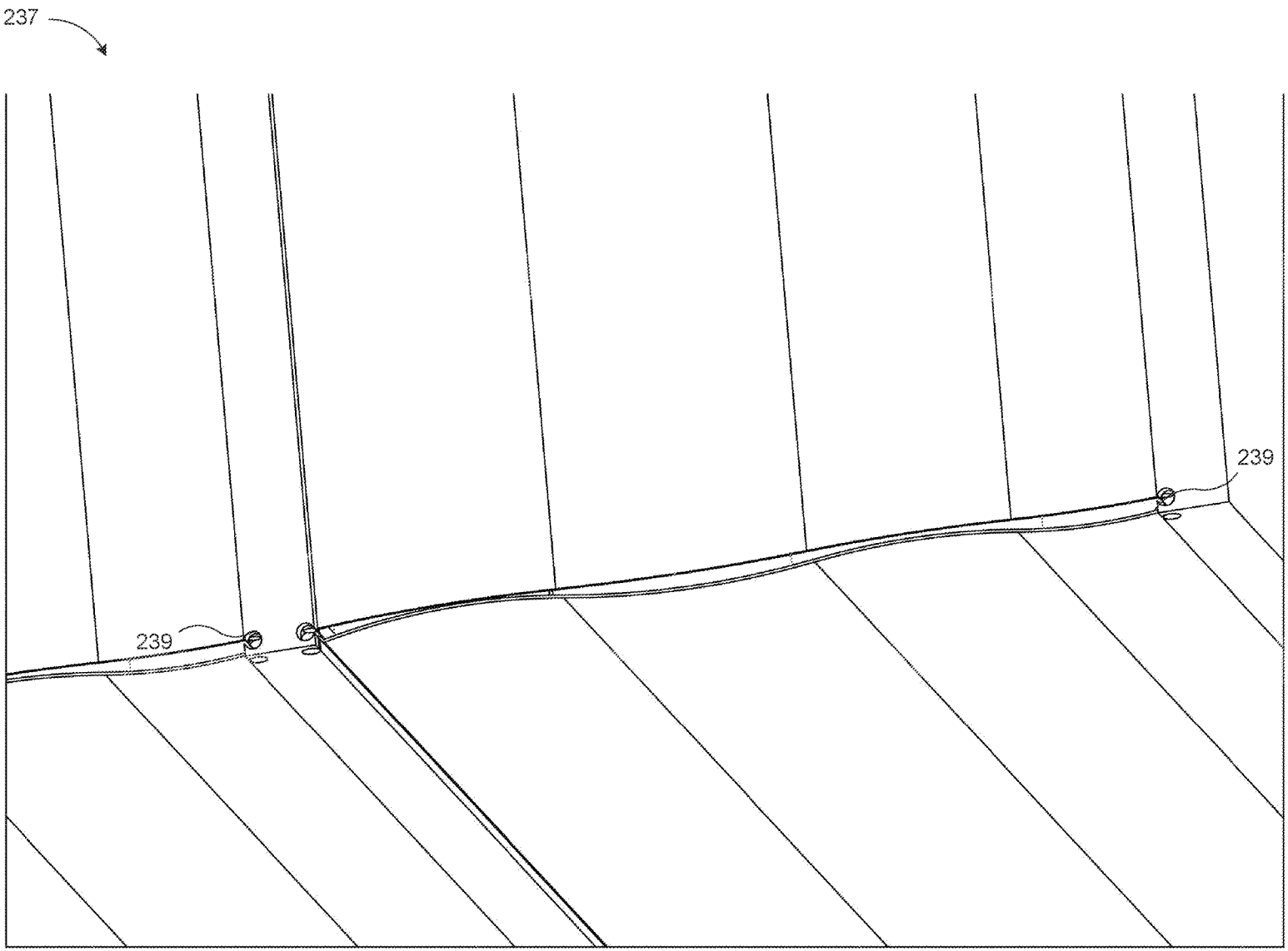
FIG. 9 depicts a fabric tensioning system of the base of the box locking system, in accordance with an example.

FIG. 9 depicts a fabric tensioning system 237 of the base of the box locking system 200. The fabric tensioning system 237 is configured to be implemented within the base of the box locking system. The fabric tensioning system 237 is configured to include a plurality of longitudinal grooves 239 that are used to insert double stretch fabrics, while also applying tension, to ensure security of the items inside the enclosure. The longitudinal grooves 239 can be positioned on one or more structural elements or the panels of the enclosure, in order to ensure that the proper tension and securing is provided to the fabric of the base.

Figure 10:
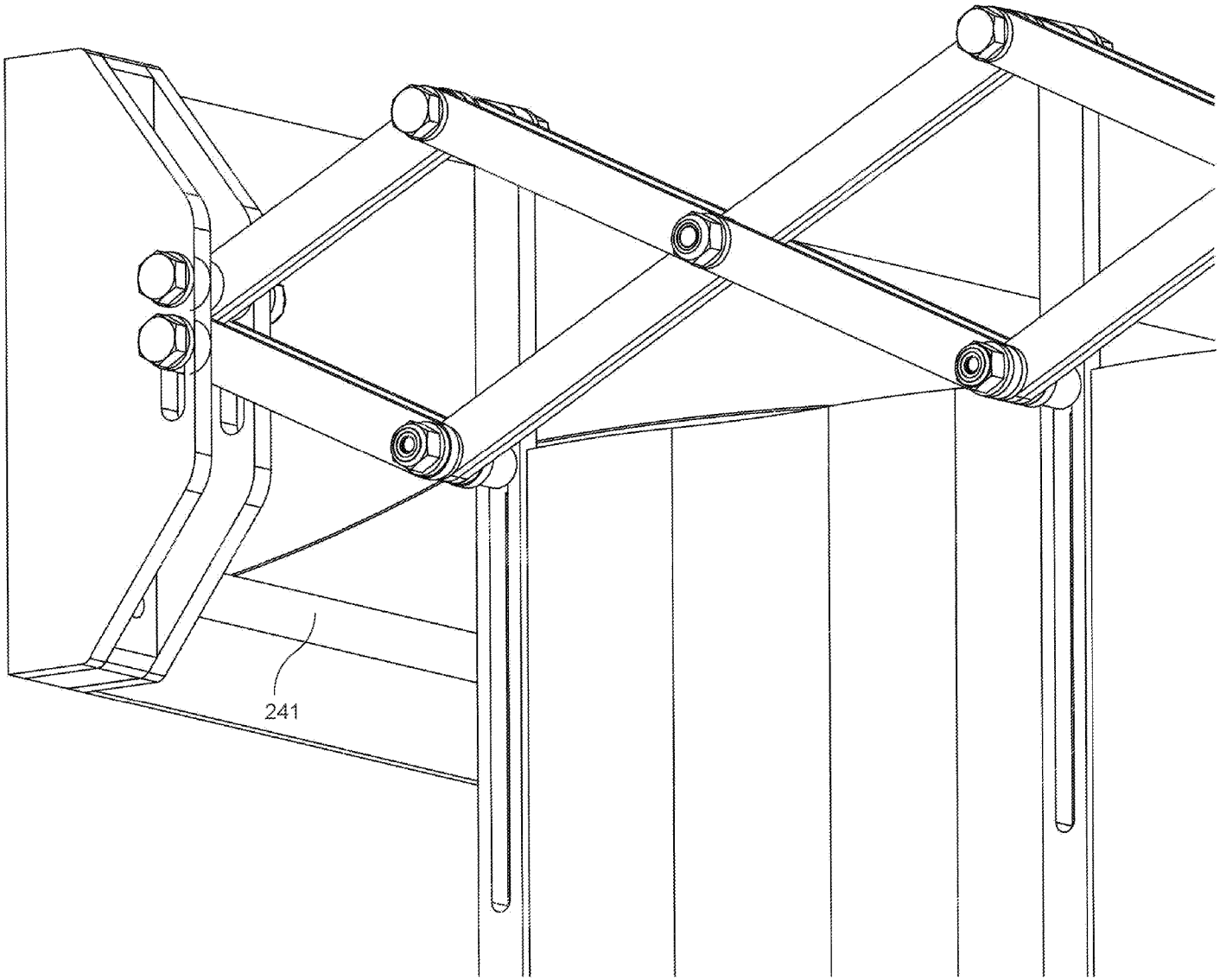
FIG. 10 depicts a fabric tensioning bar of the cover of the box locking system, in accordance with an example.

FIG. 10 depicts a fabric tensioning bar 241 of the cover of the box locking system 200. The fabric tensioning bar 241 is configured to retain the fabric of the cover at one end, creating tension that as the cover is pulled forward to cover the enclosure, consistent and secure tension is applied to the entire area of the cover. Regardless of the size of the enclosure and the cover, the cover can be stretched to multiple lengths of the enclosure as formed by the set of scissor retractors, in order to ensure that the cover creates a seal over the top portion of the panels of the enclosure, resulting in a maintained predetermined temperature.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

Although the present invention has been described in terms of various embodiments, it is not intended that the invention be limited to these embodiments. Modification within the spirit of the invention will be apparent to those skilled in the art.

It is additionally noted and anticipated that although the device is shown in its most simple form, various components and aspects of the device may be differently shaped or modified when forming the invention herein. As such those skilled in the art will appreciate the descriptions and depictions set forth in this disclosure or merely meant to portray examples of preferred modes within the overall scope and intent of the invention and are not to be considered limiting in any manner. While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the scope of the invention.

What is claimed is:

1. A package securing system configured to secure temperature sensitive packages, the system comprising:

a plurality of panels configured to form an enclosure for receiving one or more packages, wherein at least one of the panels is configured to be secured to a fixed structure;

a set of scissor retractors configured to extend and retract the plurality of panels, wherein when the set of scissor retractors are in an extended position the enclosure is formed, and when in an retracted position the plurality of panels are collapsible;

a locking handle comprising a locking mechanism positioned across the width of the enclosure, connecting the set of scissor retractors and configured to lock the scissor retractors in one or more extended positions relative to the shape of the received one or more packages, wherein the one or more extended positions forms a size of the enclosure; and a retractable cover configured to cover the enclosure relative to the size of the enclosure as formed by the scissor retractors.

2. The system of claim 1, wherein the enclosure includes the plurality of panels including a bottom panel in communication with a plurality of side panels, wherein the bottom panel is covered with a fabric configured to stretch to the size of the enclosure, based on an extended position of the set of scissor retractors.

3. The system of claim 1, wherein the set of scissor retractors are configured to retract the plurality of panels to be flush with the fixed structure.

4. The system of claim 1, wherein the locking handle is configured to lock the movement of the set of scissor retractors in the extended position or the retracted position.

5. The system of claim 1, wherein the locking handle is configured to pull and tightens a fabric upper portion of a base panel of the plurality of panels is configured to support the one or more packages resulting in the fabric comprising of a tight fit over a plurality of frames of the enclosure.

6. The system of claim 1, wherein the locking mechanism comprises:

a piston elbow comprising a piston configured to retract and extend the set of scissor retractors;

a piston cylinder configured to secure the positioning of the locking mechanism;

a plurality of serrated teeth secured to the piston configured to be in contact with a plurality of saw teeth of a ratchet, locking the set of scissor retractors into the one or more extended positions; and a solenoid configured to extend or retract the set of scissor retractors in the event that the system lacks power.

7. The system of claim 1, further comprising a controller.

8. The system of claim 7, wherein the controller is configured to extend or retract the set of scissor retractors upon activation by manual user interaction or a user equipment.

9. The system of claim 7, wherein the controller comprises one or more sensors configured to determine a position to lock the set of scissor retractors.

10. The system of claim 9, wherein the one or more sensors comprises:

an infrared red proximity sensor, or a camera sensor configured to record based on movement and the activation or deactivation of the set of scissor retractors caused by the controller.

11. The system of claim 7, wherein the controller comprises one or more LEDs comprising:

a red LED indicating an in use status;

a yellow LED indicating an error or low battery status; and a green LED indicating a ready and lock not engaged status.

12. The system of claim 7, wherein the controller is configured to receive one or more commands from an application programming interface (API) operable via a user equipment.

13. The system of claim 12, wherein the API is configured to receive one or more instructions from a user comprising:

activating the locking handle;

deactivating the locking handle; or extending the cover.

14. The system of claim 1, wherein the one or more panels comprise of insulated walls configured to maintain a predetermined temperature.

* * * * *